United States Patent [19]

Bourget

[11] 4,420,881

[45] Dec. 20, 1983

[54] METHOD OF MANUFACTURING A PREFORM FOR MINERAL-INSULATED ELECTRIC CABLE

[75] Inventor: Jean-Claude Bourget, Issy les Moulineaux, France

[73] Assignee: Les Cables de Lyon, Lyons, France

[21] Appl. No.: 301,483

[22] Filed: Sep. 11, 1981

[30] Foreign Application Priority Data

Sep. 23, 1980 [FR] France ..... 80 20393

[51] Int. Cl.[3] ..... H01R 43/00

[52] U.S. Cl. ..... 29/825; 29/816; 156/52; 174/118; 264/150

[58] Field of Search ..... 29/455 R, 517, 616; 156/51, 52; 174/102 P, 118, 96, 97, 111; 338/26, 213; 264/150, 272.15, 272.18

[56] References Cited

U.S. PATENT DOCUMENTS

| | | | |
|---|---|---|---|
| 1,523,434 | 1/1925 | Lightfoot et al. | 338/213 X |
| 2,061,350 | 11/1936 | Coupier et al. | 156/52 X |
| 2,243,881 | 6/1941 | Peters et al. | 156/51 |
| 2,495,867 | 1/1950 | Peters | 174/118 X |
| 3,017,688 | 1/1962 | Cummings et al. | 29/616 |
| 3,105,287 | 10/1963 | Whearley et al. | 156/52 X |
| 3,121,038 | 2/1964 | Perotte | 174/118 X |
| 3,452,434 | 7/1969 | Wagele | 174/118 X |
| 4,033,028 | 7/1977 | Howie et al. | 29/616 X |
| 4,101,760 | 7/1978 | Roller | 174/118 X |
| 4,106,186 | 8/1978 | Morgan, Jr. et al. | 29/616 |

FOREIGN PATENT DOCUMENTS

| | | |
|---|---|---|
| 843366 | 7/1939 | France . |
| 445070 | 4/1936 | United Kingdom . |

OTHER PUBLICATIONS

"Mineral Insulated Electric Cables" by British Insulated Callender's Limited, Research Disclosure No. 123, pp. 34–35, Jul. 1974.

*Primary Examiner*—Howard N. Goldberg
*Assistant Examiner*—Carl J. Arbes
*Attorney, Agent, or Firm*—Sughrue, Mion, Zinn, Macpeak and Seas

[57] ABSTRACT

The mineral substance is mixed (2) with an organic binder, a cylindrical structure is extruded (4), said cylindrical structure having at least one internal duct, and being cut (9) to portions of determined length before undergoing (10) heat treatment to cause the organic binder to burn, then being inserted (12) while hot in a metal sheath-forming tube, then the conductor(s) is (are) passed through the internal duct(s). Application to manufacturing heating elements or thermocouples.

5 Claims, 1 Drawing Figure

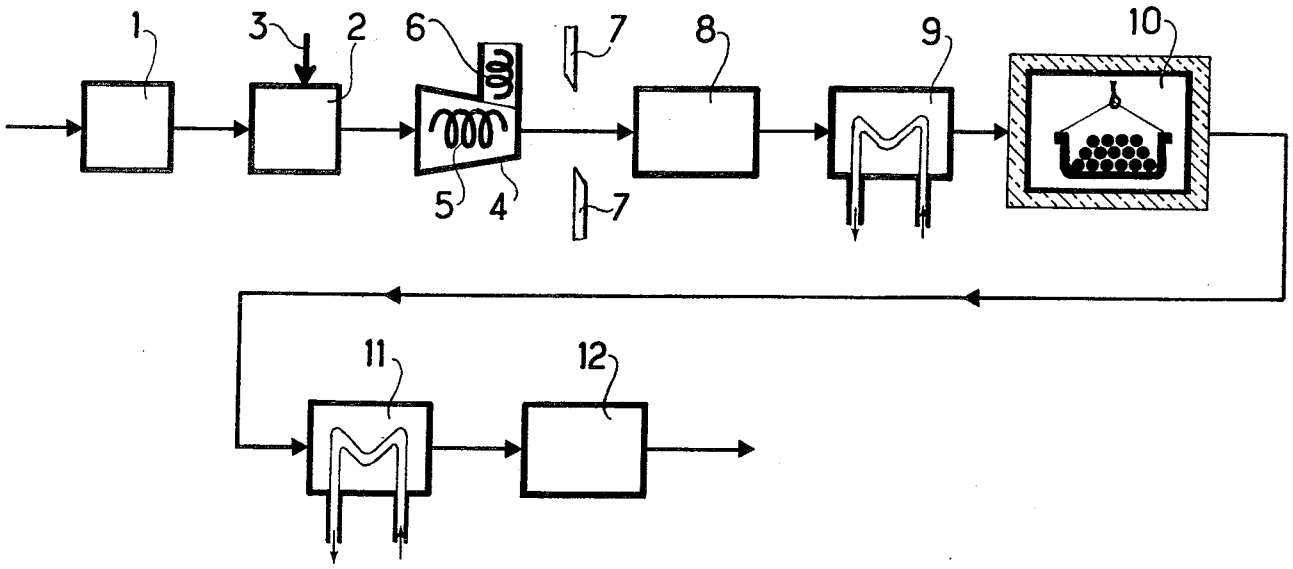
1
2
3
6
5
4
7
7
8
9
10
11
12

METHOD OF MANUFACTURING A PREFORM FOR MINERAL-INSULATED ELECTRIC CABLE

The present invention relates to a method of manufacturing a preform made of an electrically insulating substance for a mineral insulated electric cable. Such preforms are cylindrical and have one or more longitudinal ducts in which conductors are inserted.

BACKGROUND OF THE INVENTION

Up till now, preforms of this kind have been manufactured by pelletizing under high pressure.

When pelletizing under high pressure, the mineral insulating substance is dampened before being placed in a die which is then subjected to high pressure. The preforms obtained have ducts through which well centered conductors pass, but these conductors are in very short lengths (about one centimeter). Only about 2 to 16 m per hour can be produced by this discontinuous method. These elements are then inserted one after another in the tube which is to sheath them. This is a relatively long operation.

The other method of filling tubes consists in placing the mineral insulating substance in powder form in a vertically disposed metal tube fitted with its conductor(s) while compressing the powder. This method does not provide proper centering of the conductors nor such compactness as the previous one, especially during initial cable-drawing operations. Only relatively short lengths of cable can be produced by this method.

Preferred embodiments of the present invention overcome the disadvantages of both known methods and allow partially continuous preform manufacture with appreciably faster insertion in the tubes than with the pelletizing under high pressure method. Production may reach 250 m per hour under favourable conditions. The present invention can also provide good centering of the conductor-housing ducts.

SUMMARY OF THE INVENTION

In the method according to the invention;

(a) the mineral insulating substance is mixed with an organic binder;

(b) a cylindrical structure is extruded which has at least one internal duct;

(c) the extruded cylindrical structure is cut into portions of predetermined length;

(d) the portions undergo heat treatment to cause the organic binder to burn; and (e) portions are inserted while hot in a metal tube that will become the cable sheath and the conductor(s) is (are) passed through the internal duct(s).

It also has preferably at least one of the following features:

the electrically insulating mineral substance is magnesia, alumina, strontia, zirconia, beryllium oxide or boron nitride;

the quantity of organic binder which is added to the electrically insulating mineral substance is such as to obtain a mixture which has the same consistency as dry putty;

the substance is baked in a furnace whose temperature rises progressively; and the baked preform is cooled to about 200° C. in an oven, then inserted at that temperature into the metal tube designed to sheath it.

BRIEF DESCRIPTION OF THE DRAWING

A method of manufacturing a magnesia preform in accordance with the invention is described hereinafter with reference to the sole FIGURE of the accompanying drawing, which is a flow diagram of the various stages of the method.

DETAILED DESCRIPTION

In the step which takes place in a compartment represented by the square referenced 1 in the FIGURE, magnesia is purified by removing impurities therefrom, in particular by magnetic means. In the operation which is carried out in a compartment represented by a square referenced 2, an organic glue or binder brought in at 3 is added to the magnesia. The resulting mixture advantageously has the consistency of dry putty. The mixture is then brought into a schematically illustrated screw-type extruder 4 with a feed screw 5 and a perpendicular compression screw 6. The density of the cylinder formed at the outlet of the extruder is about 2.4 g/cm$^3$ and a guillotine 7 cuts this cylinder to the size of the chaplet which supports it during baking. The preforms obtained are placed on these chaplets at 8 and pass into an oven 9 where they are heated to about 250° C. The chaplets and their preforms are loaded into furnace-charging carriages and are brought into a rotary hearth or continuous pass furnace 10 in which the temperature rises progressively, where the preforms are baked in air at a temperature of approximately 1300° C. At the outlet of the furnace, the preforms are placed in an oven 11 where they are cooled down to 200° C. The preforms are then placed while still hot in tubes schematically illustrated by a square referenced 12 which are intended to sheath them while pins guide them. The tubes are then conveyed to the wire-drawing device for cables to be manufactured therein in a known manner.

Although the method which has just been described with reference to the figure of the drawing appears to be the preferred embodiment of the invention, it will be understood that various modifications can be made thereto without going beyond the scope thereof, it being possible to replace some of its operations by others which can perform the same technical function. In particular, the baking temperature must be suited to the kind of mineral insulating substance. If need be, mineral insulators other than those mentioned hereinabove can be used.

The invention applies particularly to manufacturing heating elements or thermocouples as well as any electric cable designed to be placed in a high-temperature environment.

What is claimed is:

1. A method of manufacturing a preform made of an electrically insulating mineral substance for an electric cable having compressed mineral insulation, said method comprising the steps of:

(a) mixing the mineral insulating substance with an organic binder;

(b) extruding a cylindrical structure which has at least one internal duct;

(c) cutting the extruded cylindrical structure into portions of a length corresponding to the size of a chaplet of a heat treating furnace;

(d) heat treating the portions in said furnace to cause the organic binder to burn; and (e) inserting the portions while still hot in a metal tube forming the cable sheath and passing the conductor(s) through the internal duct(s).

2. A method according to claim 1, wherein the electrically insulating mineral substance is selected from the group consisting of magnesia, alumina, strontia, zirconia, ceryllium oxide and boron nitride.

3. A method according to claims 1 or 2, wherein the quantity of organic binder which is added to the electrically insulating mineral substance is such as to obtain a mixture which has the same consistency as dry putty.

4. A method according to claim 1, wherein said heat treating step comprises baking the substance in a furnace whose temperature rises progressively.

5. A method according to claim 1 or 4, wherein said heat treating step comprises cooling the baked preform to about 200° C. in an oven prior to insertion at that temperature into the metal tube to sheath it.

* * * * *